United States Patent [19]

Potvin

[11] 4,365,531

[45] Dec. 28, 1982

[54] MITER BOX CONSTRUCTION

[75] Inventor: Alfred M. Potvin, St. Lambert, Canada

[73] Assignee: Mita Wood Products Inc., Montreal, Canada

[21] Appl. No.: 205,513

[22] Filed: Nov. 10, 1980

[51] Int. Cl.[3] ..... B27G 5/02

[52] U.S. Cl. ..... 83/767; 83/764; 83/766; 269/283; 269/295

[58] Field of Search ..... 83/766, 767, 763, 764; 269/87.2, 97, 283, 295

[56] References Cited

U.S. PATENT DOCUMENTS

| | | | |
|---|---|---|---|
| 99,398 | 2/1870 | Bullard | 83/766 |
| 154,493 | 8/1874 | King | 83/767 |
| 509,736 | 11/1893 | Hanson | 83/767 |
| 982,706 | 1/1911 | Burger | 83/766 |
| 1,006,201 | 10/1911 | Fuhrmann | 83/767 |

*Primary Examiner*—Donald R. Schran

[57] ABSTRACT

A miter box comprising a base having a flat top surface and opposed parallel elongated side edges. A pair of spaced apart side walls extend from at least one of the side edges transversely above the flat top surface. The side walls have a flat inner surface to form right angle walls with the flat top surface. A saw blade guide mechanism is provided between the pairs of side walls. The mechanism comprises an arcuate guide means adjacent each of the side edges intermediate the pair of side walls and disposed on a circular axis having a common center point. The guide means have a diametrical pivotal base member pivotally secured on the center point below the flat top surface. Support guide means is secured to the pivotal base member and extends transversely above the flat top surface and displaceable along an arcuate path between each pair of side walls. The support guide means each have a saw blade guide slot axially aligned on a common diametrical axis extending across the opposed side edges and passing through the center point. Arresting means is also provided to immovably secure the pivotal base member at a desired position along the arcuate guide means.

10 Claims, 5 Drawing Figures

MITER BOX CONSTRUCTION

BACKGROUND OF INVENTION (a) Field of the Invention

The present invention relates to a mitre box construction wherein the saw blade is captive on each side of the mitre box in guide elements which are arcuately displaceable on a common diametrical axis whereby the saw blade is precisely maintained along a desired angle.

(b) Description of Prior Art

Various types of mitre box constructions are known. The mitre box of this invention relates to the type of boxes wherein the saw blade is held stationary along a desired angle by guiding the saw blade at spaced apart locations on each side of the mitre box. A disadvantage of the conventional mitre box where the saw blade is guided in precut slots made in opposed side walls of the box, is that these slots become enlarged and distorted by repetitive sawing motion of a saw blade extending therethrough and the blade is no longer guided at an accurate angle. Such type boxes usually have slots to guide the saw at two 45° angles and one 90° angle. This type of mitre box is also limited as to the number of angles at which the saw blade can be guided. However, other types of mitre boxes are known wherein the saw blade can be guided at any angle within a desired 90° range. A disadvantage of some of these further types of mitre boxes is that the saw blade cannot be maintained precisely along a desired angle as the saw blade is reciprocated as it is held by a single guide means, such as in U.S. Pat. No. 600,118. A further disadvantage of the mitering device as taught by that patent is that the saw guide support is complex in construction and difficult to adjust on the machine. Furthermore, the saw blade is guided at a position to one side only of the workpiece being cut. Thus, the saw blade may be distorted in the area where the cut is being made, particularly if the cut in the material becomes slightly displaced and the groove made by the cut continues to guide the loose end of the saw blade in the direction of the displaced angle. Thus, the saw guide support is not effective. In the present application, there is used guide elements generally of the type as taught in this reference, but used in a different system requiring simple and effective adjustments and proper guiding of the saw blade.

SUMMARY OF INVENTION

It is therefore a feature of the present invention to provide an improved mitre box construction wherein precise mitre cuts can be achieved.

A further feature of the present invention is to provide an improved mitre box construction wherein the saw blade is captive from opposed sides of the mitre box and guided for sliding displacement along a precise desired axis.

A further feature of the present invention is to provide an improved mitre box construction which is of a compact design, easy to use, and in which a workpiece may be held in a manner whereby the workpiece is visible from opposed sides whereby the workpiece may be aligned precisely under the saw blade which is held stationary along a desired axis.

Another feature of the present invention is to provide an improved mitre box construction which is relatively inexpensive to produce as compared with known mitre boxes having similar precision characteristics.

According to the above features, from a broad aspect, the present invention provides a mitre box comprising a base having a flat top surface and opposed parallel elongated side edges. A pair of spaced apart side walls extend from at least one of the side edges transversely above the flat top surface. The side walls have a flat inner surface to form right angle walls with the flat top surface. A saw blade guide mechanism is provided between the pairs of side walls. The mechanism comprises an arcuate guide means adjacent each of the side edges intermediate the pair of side walls and disposed on a circular axis having a common center point. The guide means have a diametrical pivotal base member pivotally secured on the center point below the flat top surface. Support guide means is secured to the pivotal base member and extends transversely above the flat top surface and displaceable along an arcuate path between each pair of side walls. The support guide means each have a saw blade guide slot axially aligned on a common diametrical axis extending across the opposed side edges and passing through the center point. Arresting means is also provided to immovably secure the pivotal base member at a desired position along the arcuate guide means.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
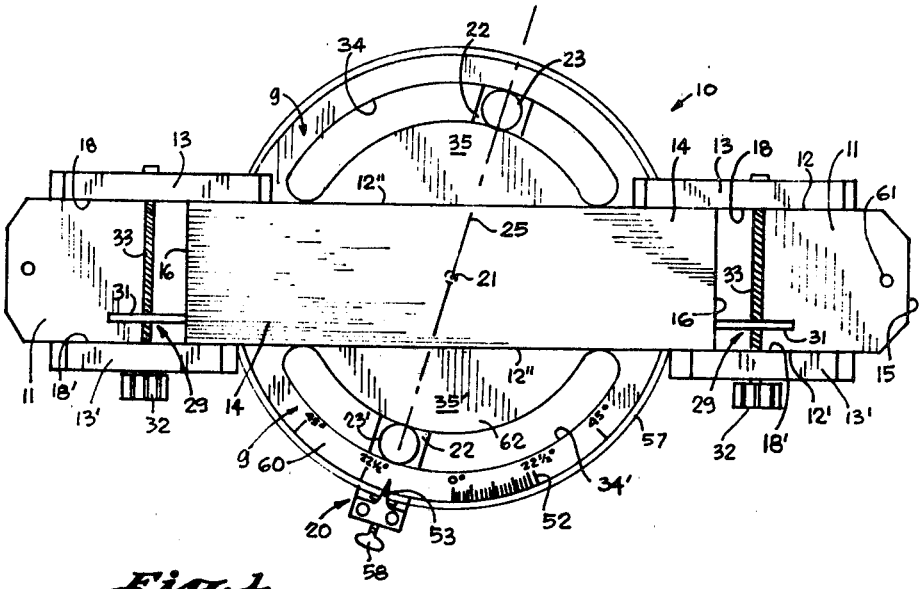
FIG. 1 is a plan view of the mitre box construction of the present invention.
Figure 2:
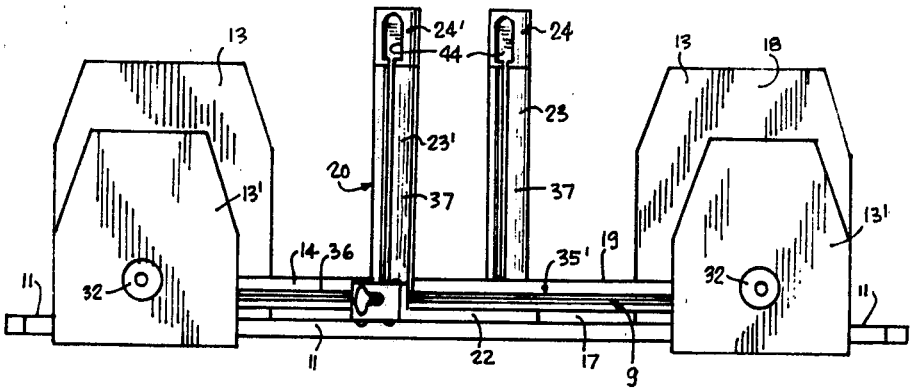
FIG. 2 is a side view of the mitre box shown in FIG. 1.

Referring now to the drawings, and more particularly to FIGS. 1 and 2, there is shown generally at 10, the mitre box of the present invention. The mitre box comprises a rectangular base member 11 having opposed parallel elongated side edges 12 and 12' with a pair of spaced apart side walls 13 and 13' extending respectively from the side edges 12 and 12'. The base member 11 also comprises a workpiece support base portion 14 which is supported on an intermediate board 9 which is supported spaced above the upper surface of the base 11. The support base portion 14 is terminated short of the ends 15 of the base. As herein shown, the end edge 16 of the workpiece support base portion 14 is a straight edge extending from between opposed side walls 13 and 13'. A space 17 is formed in the area between the board 9 and base member 11 and extends across opposed side edges 12 and 12'.

The side walls 13 and 13' have a flat inner surface 18 and 18' to form right angle walls (see FIG. 3) with the flat top surface 19 of the workpiece support base portion 14.

A saw blade guide mechanism is provided between the pairs of side walls 13 and 13' and is provided by a saw blade guide mechanism 20 adjacent each of the side edges 12 and 12' intermediate the pair of side walls 13 and 13' and disposed on a circular axis having a common center point 21. The guide mechanism 20 has a diametrical pivotal base member 22 which is formed by a flat metal rod extending in the space 17 between the base 11 and the intermediate board 9 and pivotally secured at the center point 21. Support guide means, herein constituted by tubular members 23 and 23', each having a piston blade guide member 24 and 24' slidingly received therein, are secured to the pivotal base member 22 and located adjacent a respective one of the side edges 12 and 12'.

The pivotal connection of the base member 22 permits the tubular members 23 to be aligned along a desired diametrical axis 25 passing through the center point 21 and positioned at a desired transverse angle with respect to the base portion 14. These tubular members are displaceable along an arcuate path between each pair of side walls 13 and 13'.

Figure 3:
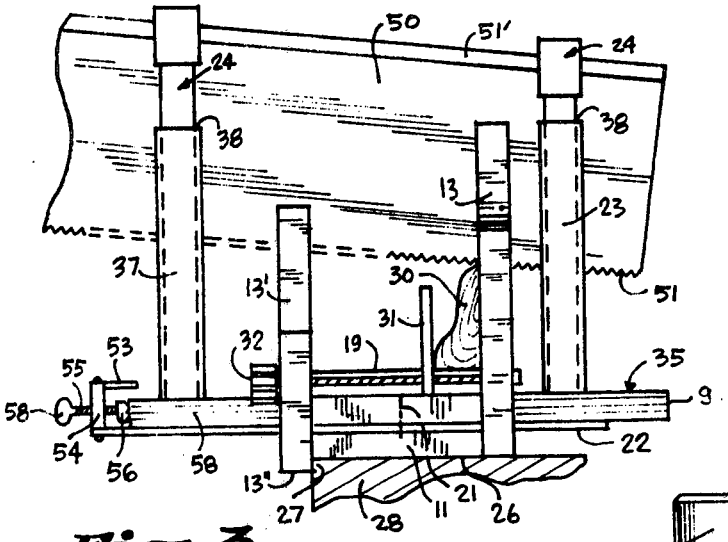
FIG. 3 is an end view of the mitre box and showing the operation thereof with respect to a saw blade.

As shown in FIG. 3, the side walls 13' have a straight lower edge 13'' which extends below the flat bottom surface 26 of the base 11 whereby the mitre box may be solidly arrested on a corner edge 27 of a flat support surface, such as a table top 28. Further, a pair of clamps 29 are secured adjacent each end edge 16 of the support base portion 14 to clamp a workpiece 30 solidly against the inner surface 18 of the side walls 13 so that the workpiece does not move when the saw blade is reciprocated thereinto to make a desired mitre cut. Briefly, the clamp member 29 comprises a clamp plate 31 extending above surface 19 and movable transversely across each pair of opposed side walls 13 and 13' by rotating a finger-gripping wheel 32 secured to a threaded bolt 33 in engagement with the shoe 31. Thus, the plate 31 may clamp a workpiece 30 against either of the inner surfaces 18 or 18' of the side walls 13 or 13'. The clamp member 29, per se, forms the subject matter of my co-pending U.S. application Ser. No. 091,331 filed on Nov. 5, 1979.

Referring now to all of the Figures, the saw blade guide mechanism 20 will be described in detail. As shown more clearly in FIG. 1, the tubular members 23 are immovably secured at a lower end to the base member 22 and extend transversely from the flat top surface 19 of the support base portion 14 and are displaced within an arcuate path defined by an arcuate slot 34 formed in wall extensions 35 and 35' of the intermediate board 9 and protruding beyond a respective one of the opposed side edges 12 and 12' intermediate a respective pair of the side walls 13 and 13'. These wall extensions are constituted by a flat rectangular board 9 having a flat top surface 36 spaced below the flat top surface 19 of the support base portion 14 and disposed intermediate the workpiece support base portion 14 and the base 11 immediately above the space 17. The tubular members 22 and 23' extend through a respective one of the arcuate slots 34 and 34' with the slots extending about a circumferential axis formed about the center point 21 and permitting displacement of the tubular members 23 and 23' through at least a 90° angle with respect to the center point.

Figure 4:
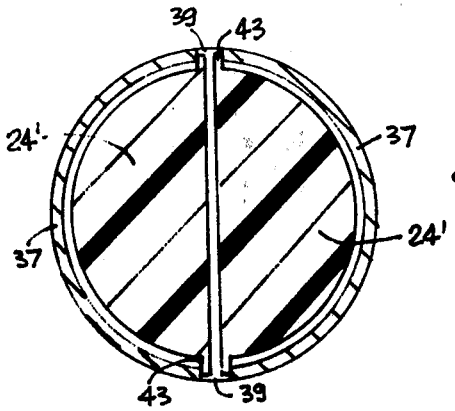
FIG. 4 is a cross-section view showing the construction of the blade guide member.
Figure 5:
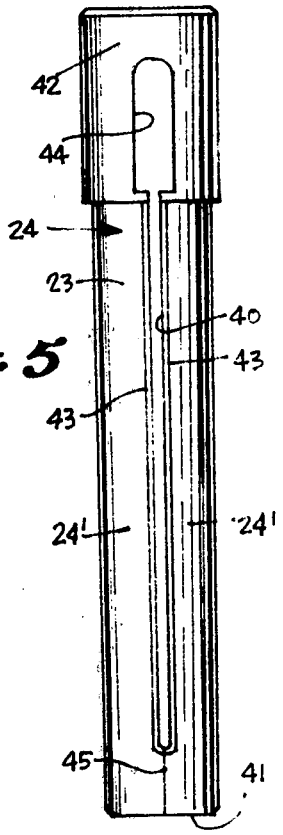
FIG. 5 is a plan view of a piston blade guide member.

As shown more clearly in FIGS. 2, 4 and 5, the tubular members 23 and 23' are comprised by a hollow piston receiving portion 37 terminating in an open top end 38 to receive a piston blade guide member 24 for axial displacement therein. The hollow piston portion 37 is provided with a pair of diametrically aligned piston guide slots 39 in the cylindrical side wall thereof and axially aligned with a saw blade guide slot 40 provided in the piston blade guide member 24.

As shown in FIG. 5, the piston blade guide member 24 is an elongated solid cylinder member having a smaller outer diameter than the inner diameter of the tubular member 37. The guide slot 40 is a transverse diametrical slot extending from adjacent a bottom end of the member 24 to a point below a solid top portion 42. An elongated narrow rib 43 protrudes from the outer face of the cylinder member 24 and is disposed adjacent at least one side edge of the transverse diametrical slot 40. As herein shown, a rib is provided adjacent each side edge of the slot on opposed diametrical sides of the member 24. These ribs 43 protrude within the piston guide slots 39 of the tubular member 23 as shown in FIG. 4 whereby to guide a saw blade 50 (see FIG. 3) along a precise diametrical axis across the guide slots 39 of each tubular member 23 and 23'.

As shown in FIG. 5, the width of the diametrical slot 40 is selected to receive a saw blade therethrough in sliding fit to permit planar axial displacement of the saw blade therethrough. The top portion of the transverse diametrical slot is enlarged, as shown at 44, to receive an enlarged top edge 51' of a mitre saw blade 50 whereby the piston blade guide member is slidingly retained on the saw blade, as shown in FIG. 3. The length of the guide slot 40 will accommodate the width of the saw blade 50. The lower end of the guide slot 40 has a slit 45 therein extending to the bottom end 41 of the member 24 to permit slight separation of the cylinder half portions 24' to facilitate the insertion of the piston blade guide members on a saw blade 50, although this is not necessary as these members are slid in from the end of the saw blade. However, with saw blades which do not have an enlarged top edge portion, they could be merely secured to the saw blade by opening the slit 45 and sliding the saw blade thereinto at any location therealong. Also, the slit 45 permits the slot 40 to accommodate saw blades of slightly greater thickness.

The top portion 42 of the cylinder member 24 is of larger diameter than the inner diameter of the tubular member. This enlarged top portion will prevent the saw blade cutting edge 51 from being spaced too far below the flat top surface 19 of the support base portion 14. However, it will permit the cutting edge to at least protrude slightly within the top surface to ensure that the workpiece is cut throughout. Also, the length of the guide slot 40 is selected to accommodate various widths of saw blades and the bottom end portion of the slot extends to a termination point which is below the flat top surface 19. The tubular member 23 and piston blade guide member 24 may be of different lengths to accommodate mitre saw blades of different widths, although it is pointed out there are only a few standard sizes of mitre saws.

Referring again to FIGS. 1 to 3, it can be seen that one of the wall extensions, herein 35', is provided with a scale 52 adjacent a peripheral outer edge portion whereby the saw blade 50 can be positioned on a diametrical axis disposed at a precise angle. A position indicator 53 is secured to a transverse end wall 54 of the base member 22 whereby to locate the diametrical axis 25 at a precise angle. In order to maintain the base member 22 stationary at a desired angle on the scale 52, there is provided an arresting means constituted by a threaded member 55 which is in threaded engagement with the transverse end wall 54 and extends therethrough. The threaded member has an arresting pad element 56 at an end thereof and disposed adjacent the outer arcuate end edge 57 of the wall extension portion 35' whereby the pad element may be moved into clamping pressure against the end edge 57 by threading the bolt 55 into the end wall 54. The outer free end of the threaded bolt 55 is provided with a finger gripping portion 58 for effecting the axial threaded displacement of the bolt. As herein shown, the outer arcuate end edge 57 has a corrugated metal strip 58 secured thereto and the clamping face 59 of the pad 56 is also corrugated whereby improved frictional contact is obtained. The strip 58 also protects the outer edge from damage while at the same time solidifying the rib portion 60 intermediate the outer arcuate end edge 57 and the arcuate slot 34.

The operation of the mitre box of the present invention will now be briefly described with reference to FIGS. 1 and 3 of the drawings. The saw blade guide mechanism 20 is positioned at a desired angle on the scale 52 by aligning the position indicator 53 on the desired degree marking. The threaded bolt 55 of the arresting member is then rotated whereby the pad 56 is gripped firmly into the end edge 57. Thus, the diametrical axis 25 is locked at a desired angle of cut.

The piston blade guide members 24 and 24' are removed from their respective tubular members 23 and 23' and fitted on a saw blade 50. The workpiece 30, to be cut, is then positioned on the flat top surface 19 and the piston blade guide members 24 and 24' are positioned in their respective tubular members thus aligning the saw blade over the workpiece 30. An indicating mark, usually made on the workpiece to indicate the position of the cut, is then aligned with the cutting edge 51 of the saw blade and the workpiece 30 is firmly held in position. As herein shown, the workpiece 30 may be held in position by the clamp members 29. The saw blade is then reciprocated, whilst being guided by the saw blade guide slots 40 in their respective piston blade guide members which are themselves held firmly in axial planar alignment in their tubular members, to effect a cut in the workpiece. It can be seen that because of the space provided between the pairs of side wall 13, that the workpiece extending therethrough is visible from either side or the top face thereof. Thus, any markings made on the workpiece indicating the precise location of the cut and made on either side or on the top face of the workpiece is visible to the user and permits more precise alignment of the diametrical axis 25 with respect thereto. Furthermore, if a cut is being made at the end of a workpiece, with such workpiece being arrested against only one of the inner surfaces of side walls 13, it is also possible to inser the fingers very close to the end of the workpiece where the cut is being made and maintain the workpiece stationary in guided alignment with the side edge 12'' of the workpiece support base portion 14. It is also pointed out that the arcuate slots 34 or 34' provide a convenient carrying handle for the mitre box for transporting same. The holes 61 adjacent the ends of the base 11 are for hanging the mitre box on a support stud, when not in use.

The mitre box construction of this invention is made substantially of plywood material with the exception that the saw blade guide mechanism 20 is made of aluminum. The tubular members 23 are also made of aluminum and the piston blade guide members 24 are made of a suitable plastic material which will provide good sliding frictional contact with the saw blade extending through the guide slot. The clamp members 29 are also made of metal parts as well as the strip 58 on the outer arcuate end edge 57. The arresting pad 56 is made of a rubber material having good frictional adherence with the strip 58 on the end edge 57.

Another important feature of the invention is that the bottom end of the hollow piston member 23 is open whereby any foreign matter that enters the tubular member 23 will fall out through the open bottom end. Thus, there will be no hindrance to the piston blade guide member 24 when positioned therein. The member 23 is secured to the base member 22 by press fitting the lower end of the member 24 in holes (not shown) provided in the member 22. Alternatively, the member 23 could be threaded in the member 22. By threading the lower portion of member 23, the length thereof, above the surface 19 may be adjusted to accommodate saws of different widths.

It is within the ambit of the present invention to provide any obvious modifications of the example of a preferred embodiment described and illustrated herein, provided such modifications fall within the scope of the appended claims. For example, the pair of side walls 13' may not be necessary and the clamp members 29 are also not essential. Still further, the saw blade guide mechanism need not require an arcuate slot 34 such as shown in the preferred embodiment and disposed along the arcuate path of the tubular members 23. The arresting means could be constructed differently to clamp the base member 22 at a desired angle and the scale could be provided, for example, along an inner arcuate edge such as along the edge portion 62, as shown in FIG. 1. Still further, the wall extension portion 35 and the arcuate slot 34 may be provided adjacent one of the side edges 12 or 12' of the base member 11 as the tubular members 23 are guided along the arcuate path due to their securement to the base 22 and the pivotal connection of the base member 22.

I claim:

1. A mitre box comprising a base having a flat top surface and opposed parallel elongated side edges, a pair of spaced apart side walls extending from at least one of said side edges transversely above said flat top surface, said side walls having a flat inner surface to form right angle walls with said flat top surface, a saw blade guide mechanism between said pairs of side walls, said mechanism comprising an arcuate guide means adjacent each said side edges intermediate said pair of side walls and disposed on a circular axis of a common center point, said guide means having a diametrical pivotal base member pivotally secured on said center point below said flat top surface, support guide means secured to said pivotal base member and extending transversely above said flat top surface and displaceable along an arcuate path between each said pairs of side walls, said support guide means each having a saw blade guide slot axially aligned on a common diametrical axis extending across said opposed side edges and passing through said center point, arresting means to immovably secure said pivotal base member at a desired position along said arcuate guide means, said support guide means being a tubular member secured at a base thereof to a respective end of said base member, a hollow piston receiving portion above said base and terminating in an open top end to receive a piston blade guide member for free axial displacement therein, said piston blade guide member having said saw blade guide slot therein, said hollow piston portion having a pair of diametrically aligned piston guide slots in the cylindrical side wall thereof and axially aligned with said saw blade guide slot in said piston blade guide member, said piston blade guide member being an elongated cylinder member being of smaller outer diameter than the inner diameter of said tubular member, said cylinder member having a transverse diametrical slot extending from a bottom end to a point below a solid top portion, and an elongated narrow rib in an outer face of said cylinder and disposed adjacent at least one side edge of said transverse diametrical slot, said rib protruding in a respective one of said piston guide slots.

2. A mitre box as claimed in claim 1 wherein there is provided a pair of said side walls extending from each said side edges.

3. A mitre box as claimed in claim 2 wherein an arcuate guide element is disposed along said arcuate path and coacts with a respective one of said support guide means.

4. A mitre box as claimed in claim 3 wherein said arcuate guide element is an arcuate slot formed in a wall extension protruding beyond a respective one of said opposed side edges intermediate a respective pair of said side walls, said support guide means extending through a respective arcuate slot, each arcuate slot permitting arcuate displacement of said guide means therealong through at least a 90° angle with respect to said center point.

5. A mitre box as claimed in claim 4 wherein said arcuate slot formed in each wall extension is disposed on a common circumferential axis concentric with said center point and extending through a 90° arc to each side of said base, at least one of said wall extensions having a scale thereon, and a position indicator secured to said base member and aligned on an elongated axis thereof passing through said center point and disposed in relationship with said scale.

6. A mitre box as claimed in claim 4 wherein said arresting means is a threaded member in threaded engagement with an end support wall of said base member extending adjacent a clamping arcuate edge of one of said wall extensions, said threaded member having an arresting end engageably securable to said clamping arcuate edge.

7. A mitre box as claimed in claim 6 wherein said arresting end is constituted by a pad element secured to the end of a threaded bolt, said threaded member when threaded into said end support wall causing said pad element to apply clamping pressure against said arcuate edge to immovably secure said base member from pivotal displacement on said center point.

8. A mitre box as claimed in claim 1 wherein one of said ribs is disposed adjacent opposed side edges of said slot on diametrically opposed surfaces of said cylinder, the width of said diametrical slot being capable of receiving a saw blade therethrough and permitting reciprocal displacement therein, said ribs on each side of said diametrical slot being receivable in a respective one of said piston guide slots of said tubular member to guide a saw blade thereacross.

9. A mitre box as claimed in claim 1 wherein a top portion of said transverse diametrical slot is enlarged to receive an enlarged top edge of a saw blade in guide reciprocable displacement therein.

10. A mitre box as claimed in claim 9 wherein said solid top portion of said cylinder member is of larger diameter than said inner diameter of said tubular member, said enlarged top portion of said slot being disposed in said solid top portion.

* * * * *